US005161905A

United States Patent [19]

Eriksson et al.

[11] Patent Number: 5,161,905

[45] Date of Patent: Nov. 10, 1992

[54] APPARATUS FOR RECORDING AND/OR READING INFORMATION

[76] Inventors: Björn S. H. Eriksson, Dragonvägen 6, 191 78 Sollentuna; Lars G. Wiberg, Prostvägen 11, 171 64 Solna, Sweden

[21] Appl. No.: 653,831

[22] Filed: Feb. 11, 1991

[30] Foreign Application Priority Data

Feb. 9, 1990 [SE] Sweden ..... 9000475

[51] Int. Cl.[5] ..... B41J 13/03

[52] U.S. Cl. ..... 400/637.1; 400/73; 400/48; 400/55; 400/642

[58] Field of Search ..... 400/23-25, 400/28, 48, 55, 56, 601, 636, 637, 637.1, 642, 644, 645, 645.3, 645.4, 73, 82

[56] References Cited

U.S. PATENT DOCUMENTS

| | | | |
|---|---|---|---|
| 4,164,376 | 8/1979 | Yarp | 400/642 |
| 4,488,367 | 12/1984 | Yamauchi et al. | 400/28 |
| 4,516,866 | 5/1985 | Yamauchi et al. | 400/28 |
| 5,000,597 | 3/1991 | Kilb et al. | 400/642 |

FOREIGN PATENT DOCUMENTS

| | | | |
|---|---|---|---|
| 41286 | 3/1984 | Japan | 400/642 |
| 67072 | 4/1984 | Japan | 400/642 |
| 61-23357 | 1/1986 | Japan . | |
| 120776 | 6/1986 | Japan | 400/73 |
| 143162 | 6/1986 | Japan | 400/642 |
| 294572 | 12/1987 | Japan | 400/642 |
| 67171 | 3/1988 | Japan | 400/642 |
| 1527634 | 4/1975 | Sweden . | |
| 8401146 | 9/1985 | Sweden . | |
| WO 84/00324 | 2/1984 | World Int. Prop. O. . | |

OTHER PUBLICATIONS

IBM Technical Disclosure Bulletin, "Document Feed Device", vol. 32, No. 8A, Jan. 1990, p. 244-245.

*Primary Examiner*—Edgar S. Burr
*Assistant Examiner*—J. R. Keating

[57] ABSTRACT

A head (9 or 10) records information on or reads information from a document (29) transportable along a transport path (3). A guide slide (17) guides the document (29) along the transport path (3). The guide slide is displaceable into and above the interaction region (28) for the head and the document to essentially bridge over this region during the feeding in and/or feeding out of the document.

9 Claims, 2 Drawing Sheets

APPARATUS FOR RECORDING AND/OR READING INFORMATION

FIELD OF THE INVENTION

The present invention relates to an apparatus for recording information on a document and/or reading information from the same, comprising a recording and/or reading head for cooperation with the document in an interaction region, a transport path for the document starting from an input/output opening in the apparatus, means for driving the document along the transport path, and means for guiding the document. Apparatus of this kind are inter alia suitable as printers and are used for example for recording and/or reading information on or from the document, respectively, such as paper sheets, books, booklets, bank books and similar documents.

BACKGROUND OF THE INVENTION

A printer according to the preamble is previously known from, for example, SE B 8401146-9. The document is fed in through an input/output opening along a transport path. In the transport path and in connection with the print bar of the printer there is an interaction region in which the head cooperates with the document. On both sides of the interaction region there are a drive roll and a pressure roll to drive the document. Inside the inner drive roll and pressure roll is a guide rail to guide the document. In the above mentioned publication it is furthermore indicated that the printing head of the apparatus may be constructed to print at several stations. In what way this is carried out is not shown but may, for example, be obtained by rotating the head in correspondence with the subject matter shown in SE B 7604415-5 which correspond to British Patent GB 1527634. In this case the head is rotatable between two print stations around a shaft parallel to the movement direction of the head.

A drawback in the prior art printer is that the fed document is not guided in the interaction region above the print bar or in its vicinity. Documents which are particularly difficult to handle, such as for example bank books having spreading paper sheets and fed from a side, easily deviate from the transport path and may be damaged or damage the apparatus and at the same time recording or reading is not possible during the input and output process. The operator is forced to make new attempts with relatively small chances to succeed.

SUMMARY OF THE INVENTION

The object of the invention is to obtain an apparatus operating safely even when recording and/or reading information in documents which are difficult to handle. This is obtained by improving the guidance of the document under the input and under the output. When the document is fed in or fed out, a displacable guide slide is displaced above the interaction region to substantially bridge this region. Spreading paper sheets in a bank book are thereby prevented from deflecting from the transport path and are as intended guided further on along this path. When recording and/or reading, the guide slide is displaced away from the interaction region along the transport path to leave the interaction region open for the print head. To obtain a safe operation even when the documents are difficult to handle, the apparatus according to the invention is characterized in that the means for guiding the document comprises a guide slide displacable along the transport path, the guide slide of which during the input or output of the document past the interaction region is displaced to a first position to essentially bridge the interaction region, the guide slide during the recording and/or reading of the head being displaced to a second position to expose the interaction region.

According to a preferred embodiment of the invention, the guide slide comprises an essentially flat plate having a number of bent lugs along the side edge adjacent to the interaction region. The space between the lugs accommodates the drive and pressure rolls when the guide slide is in a first position in which the guide slide bridges the interaction region.

According to a second preferable embodiment of the apparatus according to the invention, in which the head is rotatable between two or more positions around an axis parallel to the movement direction of the head, the displacement movement of the guide slide is transferred from a drive common for the rotation of the head and the displacement of the guide slide. In this embodiment there is no need for a separate driving of the guide slide, but a head rotation drive is used. This results in a reduced cost for the components while simuntaneously providing a compact construction.

An advantageously constructed embodiment of the apparatus having a common drive for the head rotation and the displacement of the guide slide and in which the head rotation is obtained by a cradle supporting the head is characterized in that the common driving of the head and the guide slide is obtained from a shaft driven by a motor, the rotation of the shaft being transferred to the head by a gear coupling to the cradle supporting the head and to a translation movement of the guide slide by a circular cylindric body provided excentrically on the shaft, on the envelope surface of which is rotatably resting a circular cylindric ring having a projection which is in an articulated connection with an arm pivotally attached in one end, the other end of which engaging the guide slide.

Advantageously the coupling of the motor driven shaft to the cradle and the guide slide is doubled. According to a further preferred embodiment of the invention the apparatus is characterized in that the transfer of the rotation of the motor driven shaft to the cradle and guide slide is doubled in that a transfer to the cradle is provided in each end of the cradle and a transfer to the guide slide is provided in each of the side edges of the guide slide parallel to the displacement direction of the guide slide. These and other aspects of the invention will be apparent from and elucidated with refrence to the embodiment described hereinafter.

IN THE DRAWINGS

The invention will now be described in more detail with reference to the accompanying drawings, in which:

FIGS. 1*a*, 1*b* and 1*c* are side elevation views of an apparatus according to an embodiment of the invention having one side wall removed in a write position, FIG. 1*a*, an intermediate position, FIG. 1*b*, and a read position, FIG. 1*c*, and FIG. 2 is a perspective view showing an example of a guide slide for use in the apparatus according to the invention.

DESCRIPTION OF THE PREFERRED EMBODIMENT

Figure 1A:
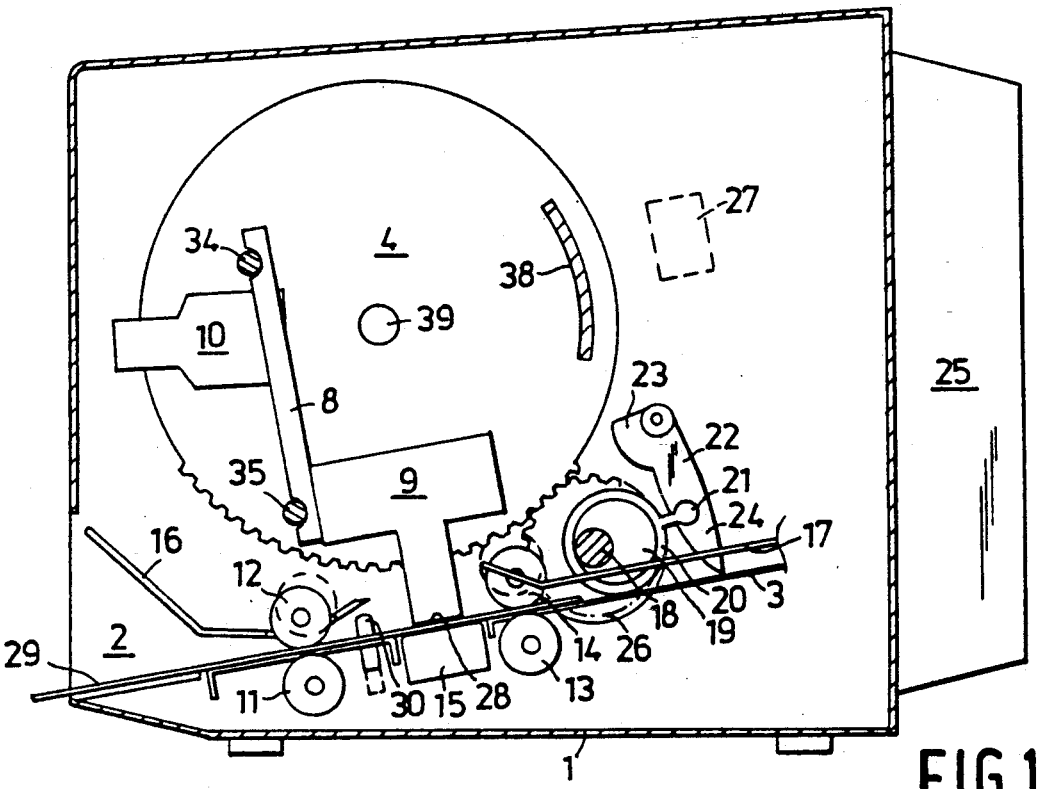
Figure 1B:
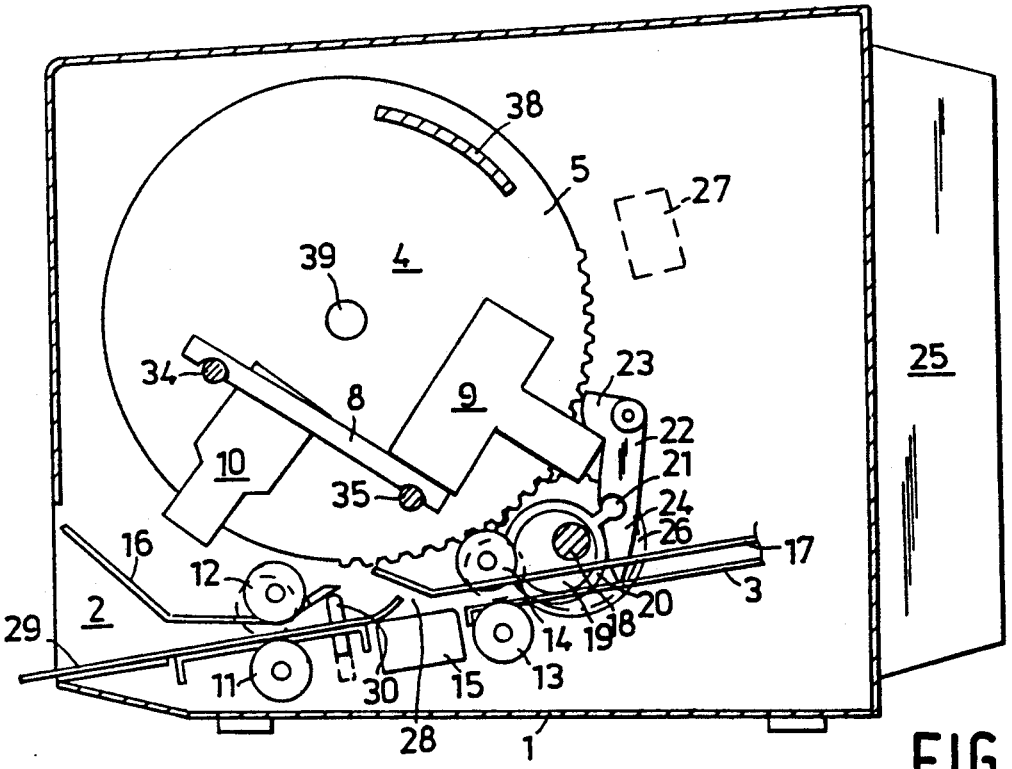
Figure 1C:
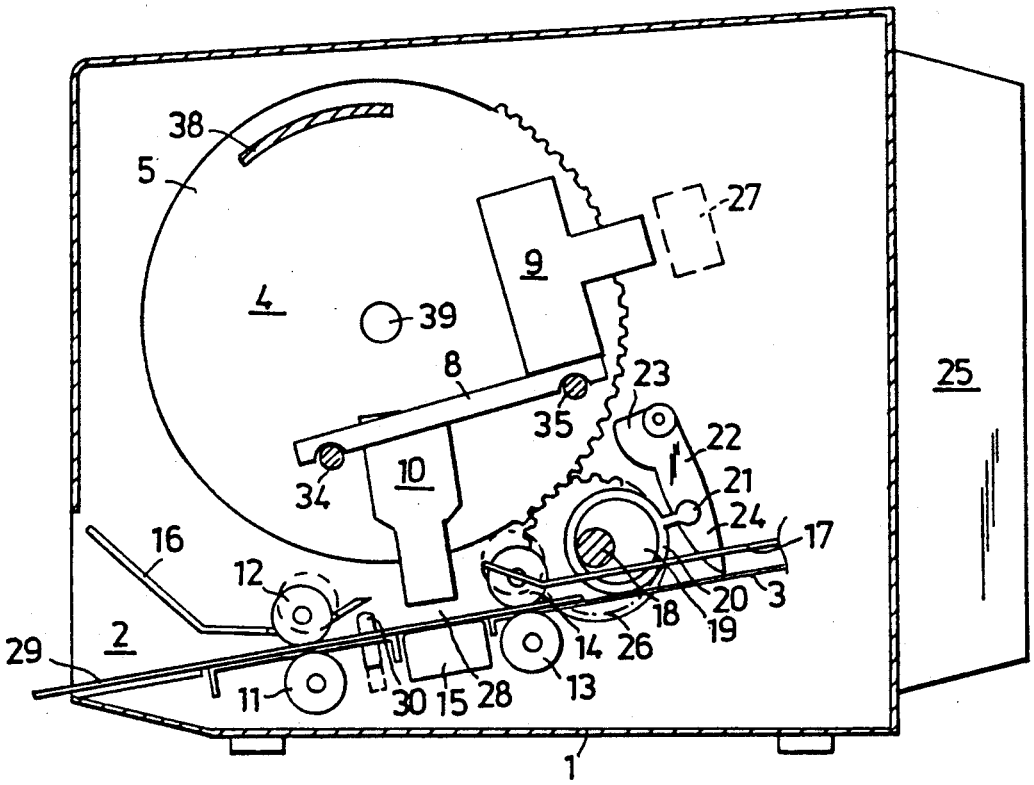

The apparatus shown in FIGS. 1*a*, 1*b* and 1*c* for recording and reading comprises a housing 1 having an input/output opening 2. A transport path 3 starts from the input/output opening and extends to the rear of the apparatus. Above the transport path 3 there is a cradle 4. The cradle 4 (not shown in more detail) in this embodiment comprises two parallel end plates provided with teeth, one end plate 5 being shown between which two rods 34, 35 are attached. A support plate 38, which like the rods 34, 35 is attached between the end plates of the cradle, forms in cooperation with the rods solid cradle 4. The cradle 4 has bearing points 39 in the center of the end plates. A carriage 8 supporting one or several heads runs along the rods 34, 35. One of the shown heads 9 is a printing head, while the other head 10 is an optical read head (OCR). The cradle 4 is rotated between the two outermost positions shown in FIGS. 1*a* and 1*c*. The printing head 9 is in a write position for documents fed in through the front in FIG. 1*a*, while the optical read head 10 is in read position for documents fed in through the front in FIG. 1*c*. In the rear section of the apparatus there is a space 25 for electronics needed for the controlling and driving of the apparatus.

Along the transport path 3 there is a front drive roll 11 which cooperates with a front pressure roll 12, with a rear drive roll 13 and with a rear pressure roll 14 to drive a document 29. The drive rolls 11 and 13 are driven by a, not shown, drive motor in a conventional way. The front and rear pressure rolls are for the sake of simplicity shown as a single roll but both may in practice consist of several essentially coaxially arranged pressure rolls. A print bar 15 is mounted between the front and the rear rolls. An interaction region 28 for the head 9 and 10, respectively, and the document 29 is located above the print bar. A guide rail 16 in connection with the input/output opening 2 guides the document fed in along the transport path 3 during the initial feeding of the document 29. A guide slide 17 takes over the guiding along the transport path 3 during the continued feeding in of the document. In order to prevent the fed document from deviating form the transport path 3 during its continued feeding in, the slide 17 is displacable above the interaction region 28 above the print bar 15. The displacement of the guide slide 17 is obtained by a, not shown, drive motor which is coupled to a shaft 18. A circular cylindric body 19 is eccentrically mounted on the shaft 18. A ring 20 rests slidably against the circular cylindric body 19 and has a projection 21 in articulated connection with an arm 22. One end of the arm 22 is pivotally secured while the other end 24 engages the guide slide 17 via opening 33, FIG. 2.

The shaft 18 furthermore supports a gear wheel 26 which cooperates with the teeth of one of the plates 5 of the cradle 4. By rotating the shaft 18, the guide slide 17 is moved between a first end position shown in FIG. 1*b* and a second end position shown in FIGS. 1*a* and 1*c*. Simultaneously with the movement of the guide slide 17 from the second end position according to FIG. 1*a* to the second position according to FIG. 1*c*, the cradle 4 is rotated such an angle that the print head 9 is moved away from the interaction region 28 at the same time as the read head 10 comes into position in the interaction region. In this position the print head 9, as indicated in FIG. 1*c*, may be arranged to cooperate with one further print bar 27 in another write position. In this other write position, for example, printing may take place on a receipt and/or journal strip type document. One transfer of the rotation of the shaft 18 through the cradle 4 and the guide slide 17 has only been described above. For a stable and operation safe transfer of the rotation of the shaft, the apparatus normally is provided with double transfers to the cradle 4 and the guide slide 17. Thereby a transfer is provided at each end of the cradle 4 and the guide slide 17, respectively.

Below the input and output process for a document 29 will be described in more detail step by step with reference to FIGS. 1*a*, 1*b* and 1*c*.

When a document is introduced into the input/output opening 2 by an operator, the apparatus ensures that the cradle 4 and the guide slide 17 are in the position shown in FIG. 1*b*. This is done by rotation of the drive motor driven shaft 18. The gear wheel 26 fixed to the shaft 18 thereby via its gear coupling transfers a rotation movement to the end plate 5 of the cradle 4. At the same time the shaft 18 transfers a translation movement to the guide slide 17 via the circular cylindric body 19, the ring 20 having the projection 21, and the arm 22 being pivotally secured in one of its ends.

The apparatus may obtain information that a document 29 is fed in several different ways. One way is that the operator supplies this information. Another possibility is that the apparatus in an optical mode or another way detects the document and not until the cradle 4 and the guide slide 17 have occupied the intermediate position shown in FIG. 1*b*, opens the transport path 3 by lowering stop pins 30 provided in the transport path.

When the stop pins 30 are lowered, FIGS. 1*a* or 1*c*, the upper front roll 12 is lowered against the front feed roll 11 and the document 29 is gripped and fed further on into the apparatus by the front rolls. The document is prevented from deviating from the transport path 3 by the guide slide 17. When the document 29 has entered the space between the rear rolls 13 and 14, the upper rear roll 14 may be lowered to grip and feed the document further at the same time that the front drive rolls are disengaged or, in the alternative, driven in parallel with the rear rolls.

In dependence on the instructions applied to the apparatus, the cradle 4 either assumes the position shown in FIG. 1*a* for printing or the position shown in 1*c* for reading. The rotational movement of the heads 9, 10 as well as the translation movement of the guide slide 17 are obtained as before by rotating the shaft 18. Clockwise rotation of the shaft 18 results in a change over to the read position while a counter clockwise rotation results in a change over to the write position for the shown embodiment. The interaction region 28 above the print bar 15 is uncovered in these positions and writing or reading may take place in this interaction region. The position of the document 29 relative to the position of the head in action is changed by rotating the rear roll pair and/or the front roller pair.

When the document 29 is ready to be discharged, the feed rolls 11 and 13, respectively, are reversed and the document 29 follows the transport path 3 in a direction towards the input/output opening 2 and is discharged therethrough. According to one embodiment, the cradle 4 and the guide slide 17 may be repositioned into an intermediate position to cover the interaction region before the document is discharged. In many applications this is not necessary, but the guide slide may be allowed to remain in the second position shown in FIGS. 1*a* or 1*c*.

Figure 2:
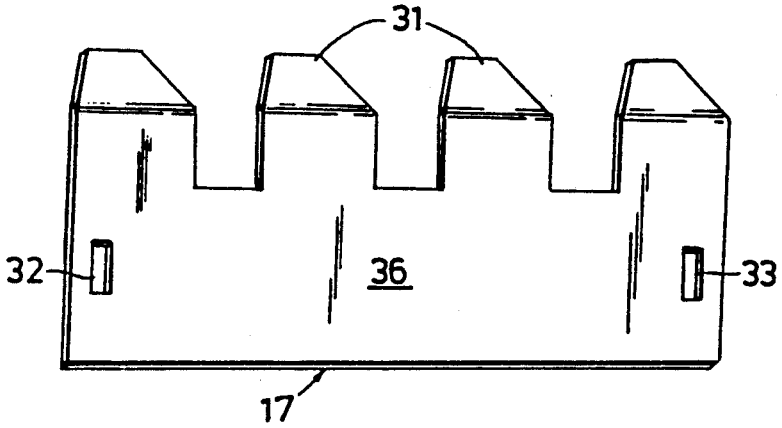

A simple embodiment of the guide slide 17 is shown in FIG. 2. The guide slide 17 comprises an elongated plate 36 and a plurality of bent lugs 31 spaced along one of the long sides of plate 36, the long side of which is brought into and above the interaction region 28. The space between the lugs 31 accommodates the rear pressure roll 14 when the guide slide 17 is brought into and above the interaction region. At each short side of the guide slide there is an opening 32 and 33, respectively, for engagement with the end 24 of the arm 22.

What is claimed is:

1. A read/write apparatus for selectively reading and writing information on a document comprising:

at least one head for a selected one of said reading and writing said document in an interaction region of said apparatus;

means for providing a document transport path through said interaction region;

document drive means for driving said document along said transport path;

means for rotatably securing the head between at least two head positions;

guide means for guiding the document along said path including a guide slide displaceable along said path; and displacement means for displacing the guide slide to a first slide position at said interaction region for guiding said document at said interaction region and for displacing the guide slide to a second slide position for exposing the interaction region to said at least one head to permit said selected one of said reading and writing of said document at said interaction region in one of said at least two head positions, said displacement means including common drive means for rotating said head to said two head positions and for displacing said guide slide to said two slide positions.

2. The apparatus of claim 1 wherein said common drive means includes means for simultaneously rotating said at least one head while displacing said guide slide.

3. The apparatus of claim 1 wherein said displacement means includes a cradle for rotatably supporting the head, said drive means including a drive shaft and connection means secured to said shaft and engaged with said guide slide for displacing said guide slide in response to rotation of said shaft and cradle rotating means coupled to said cradle and to said shaft for rotating the cradle in response to said shaft rotation.

4. The apparatus of claim 3 wherein said connection means comprises a body having a circular cylindrical peripheral surface eccentrically secured to said shaft, a circular cylindrical ring slidably secured to the peripheral surface of the body, a projection member secured to and extending from said ring and articulated means including an arm pivotally mounted at one end and engaged with said slide at its other end, said arm being coupled to and responsive to displacement of said projection in response to rotation of said shaft for displacing said guide slide.

5. The apparatus of claim 3 wherein the cradle has opposing ends, said slide has opposing edges parallel to the displacement direction of the slide, further including first and second connection means at each of said opposing edges engaged with the slide at said edges, said cradle rotating means including first and second rotating means coupled to the cradle at said cradle opposing ends.

6. A read/write apparatus for selectively reading and writing information on a document comprising:

at least one head for a selected one of said reading and writing said document in an interaction region of said apparatus;

means for providing a document transport path through said interaction region;

document drive means for driving said document along said transport path;

means for rotatably securing the head between at least two head positions;

guide means for guiding the document along said path including a guide slide displaceable along said path; and displacement means for displacing the guide slide to a first slide position at said interaction region for guiding said document at said interaction region and for displacing the guide slide to a second slide position for exposing the interaction region to said at least one head to permit said selected one of said reading and writing of said document at said interaction region in one of said at least two head positions, said displacement means including drive means for simultaneously rotating said head to a selected one of said two head positions while displacing said guide slide to a selected one of said two slide positions.

7. The apparatus of claim 6 wherein said displacement means includes a cradle for rotatably supporting the head, said slide drive means including a drive shaft and connection means secured to said shaft and engaged with said guide slide for displacing said guide slide in response to rotation of said shaft and cradle rotating means coupled to said cradle and to said shaft for rotating the cradle in response to said shaft rotation.

8. The apparatus of claim 7 wherein said connection means comprises a body having a circular cylindrical peripheral surface eccentrically secured to said shaft, a circular cylindrical ring slidably secured to the peripheral surface of the body, a projection member secured to and extending from said ring and articulated means including an arm pivotally mounted at one end and engaged with said slide at its other end, said arm being coupled to and responsive to displacement of said projection in response to rotation of said shaft for displacing said guide slide.

9. The apparatus of claim 7 wherein the cradle has opposing ends and the slide has opposing edges parallel to the displacement direction of the slide, further including first and second connection means at each of said opposing edges engaged with the slide at said edges, said cradle rotating means including first and second rotating means coupled to the cradle at said cradle opposing ends.

* * * * *